US010226097B2

(12) United States Patent
Farris et al.

(10) Patent No.: US 10,226,097 B2
(45) Date of Patent: Mar. 12, 2019

(54) FOOTWEAR SOLE STRUCTURE WITH NONLINEAR BENDING STIFFNESS

(71) Applicant: Nike, Inc., Beaverton, OR (US)

(72) Inventors: Bryan N. Farris, North Plains, OR (US); Austin Orand, Portland, OR (US); Alison Sheets-Singer, Portland, OR (US); Aaron B. Weast, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 139 days.

(21) Appl. No.: 15/266,638

(22) Filed: Sep. 15, 2016

(65) Prior Publication Data

US 2017/0079374 A1 Mar. 23, 2017

Related U.S. Application Data

(60) Provisional application No. 62/220,633, filed on Sep. 18, 2015, provisional application No. 62/220,758,
(Continued)

(51) Int. Cl.

| | |
|---|---|
| ***A43B 13/12*** | (2006.01) |
| ***A43B 13/14*** | (2006.01) |
| ***A43B 13/04*** | (2006.01) |
| ***A43B 13/18*** | (2006.01) |
| ***A43B 17/02*** | (2006.01) |
| ***A43B 13/22*** | (2006.01) |

(Continued)

(52) U.S. Cl.

CPC ..... *A43B 13/141* (2013.01); *A43B 13/04* (2013.01); *A43B 13/12* (2013.01); *A43B 13/127* (2013.01); *A43B 13/181* (2013.01); *A43B 13/186* (2013.01); *A43B 13/188* (2013.01); *A43B 13/223* (2013.01); *A43B 17/02* (2013.01); *A43B 23/026* (2013.01); *A43B 23/028* (2013.01); *A43C 15/16* (2013.01); *A43B 5/02* (2013.01)

(58) Field of Classification Search

CPC ..... A43B 13/00; A43B 13/12; A43B 13/14; A43B 13/141; A43B 5/0411; A43B 3/26
USPC ..... 36/102, 30 R, 25 R, 150, 151, 155, 158, 36/168, 171, 178, 179, 181
See application file for complete search history.

(56) References Cited

U.S. PATENT DOCUMENTS 634,588 A 10/1899 Roche
2,114,526 A * 4/1938 Feder ..... A43B 7/142 36/168

(Continued)

FOREIGN PATENT DOCUMENTS

DE 102012104264 A1 11/2013
EP 1483981 A1 12/2004

(Continued)

*Primary Examiner* — Marie D Bays
(74) *Attorney, Agent, or Firm* — Quinn IP Law

(57) ABSTRACT

A sole structure for an article of footwear comprises a first plate and a second plate. The first plate overlies at least a portion of a forefoot region of the second plate. The first plate and the second plate are fixed to one another rearward of the forefoot region. The first plate is configured to slide longitudinally relative to the forefoot region of the second plate in a first portion of a flexion range during dorsiflexion of the sole structure, and to interfere with the second plate during a second portion of the flexion range that includes flex angles greater than in the first portion of the flexion range.

18 Claims, 12 Drawing Sheets

Related U.S. Application Data filed on Sep. 18, 2015, provisional application No. 62/220,638, filed on Sep. 18, 2015, provisional application No. 62/220,678, filed on Sep. 18, 2015.

(51) Int. Cl.

| | |
|---|---|
| ***A43B 23/02*** | (2006.01) |
| ***A43C 15/16*** | (2006.01) |
| *A43B 5/02* | (2006.01) |

(56) References Cited

U.S. PATENT DOCUMENTS

| | | | | | |
|---|---|---|---|---|---|
| 2,227,426 | A * | 1/1941 | Davis, Jr. | A43B 7/142 | 36/160 |
| 2,379,139 | A | 6/1945 | Flink | | |
| 2,413,545 | A * | 12/1946 | Cordi | A43B 5/12 | 116/67 R |
| 2,640,283 | A | 6/1953 | McCord | | |
| 4,667,423 | A * | 5/1987 | Autry | A43B 13/12 | 36/102 |
| 4,779,361 | A | 10/1988 | Kinsaul | | |
| 4,924,606 | A * | 5/1990 | Montgomery | A43B 3/30 | 36/102 |
| 5,517,769 | A * | 5/1996 | Zhao | A43B 13/18 | 36/27 |
| 6,237,255 | B1 * | 5/2001 | Renaudin | A43B 3/26 | 36/102 |
| 7,513,065 | B2 | 4/2009 | Kita et al. | | |
| 7,600,332 | B2 * | 10/2009 | Lafortune | A43B 7/142 | 36/30 R |
| 8,104,195 | B2 * | 1/2012 | Cavasin | A43B 3/26 | 36/117.3 |
| 8,365,444 | B2 | 2/2013 | Youngs | | |
| 9,066,559 | B2 * | 6/2015 | Butler | A43B 13/386 | |
| 2002/0007571 | A1 * | 1/2002 | Ellis, III | A43B 13/141 | 36/102 |
| 2003/0140523 | A1 * | 7/2003 | Issler | A43B 3/0047 | 36/37 |
| 2005/0039350 | A1 | 2/2005 | Hung | | |
| 2005/0081401 | A1 * | 4/2005 | Singleton | A43B 7/14 | 36/34 R |
| 2007/0039208 | A1 | 2/2007 | Bove et al. | | |
| 2014/0250723 | A1 | 9/2014 | Kohatsu | | |
| 2017/0079375 | A1 | 3/2017 | Bunnell et al. | | |
| 2017/0079376 | A1 | 3/2017 | Bunnell et al. | | |
| 2017/0079378 | A1 | 3/2017 | Farris et al. | | |

FOREIGN PATENT DOCUMENTS

| | | | |
|---|---|---|---|
| FR | 892219 | A | 3/1944 |
| FR | 2974482 | A1 | 11/2012 |
| WO | 2006087737 | A1 | 8/2006 |
| WO | 2011005728 | A1 | 1/2011 |

* cited by examiner

FOOTWEAR SOLE STRUCTURE WITH NONLINEAR BENDING STIFFNESS

CROSS-REFERENCE TO RELATED APPLICATIONS

This application claims the benefit of priority to U.S. Provisional Application No. 62/220,633 filed Sep. 18, 2015, which is hereby incorporated by reference in its entirety. This application claims the benefit of priority to United States Provisional Application No. 62/220,758 filed Sep. 18, 2015, which is hereby incorporated by reference in its entirety. This application claims the benefit of priority to U.S. Provisional Application No. 62/220,638 filed Sep. 18, 2015, which is hereby incorporated by reference in its entirety. This application claims the benefit of priority to U.S. Provisional Application No. 62/220,678 filed Sep. 18, 2015, which is hereby incorporated by reference in its entirety.

TECHNICAL FIELD

The present teachings generally relate to an article of footwear and a sole structure for an article of footwear.

BACKGROUND

Footwear typically includes a sole assembly configured to be located under a wearer's foot to space the foot away from the ground. Sole assemblies in athletic footwear are configured to provide desired cushioning, motion control, and resiliency.

DESCRIPTION

Figure 1:
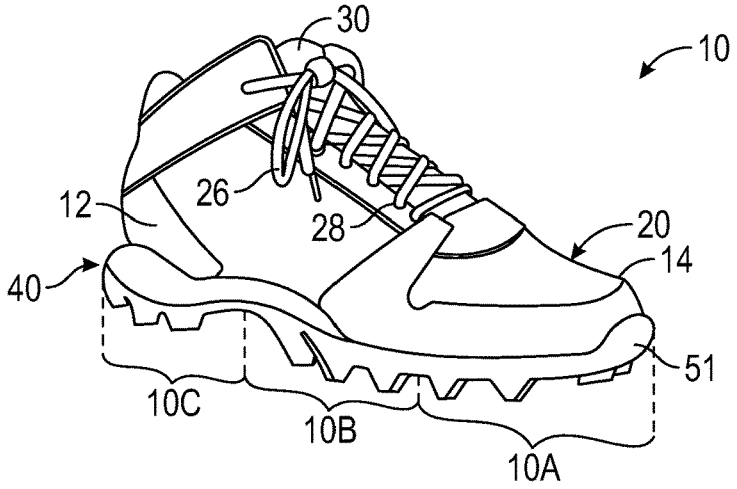
FIG. 1 is a lateral side perspective view of an article of footwear according to an exemplary embodiment of the present disclosure.

The present disclosure generally provides a sole structure for footwear having a forefoot region, a heel region, and a midfoot region between the forefoot region and the heel region. The heel region may also be referred to as a rearfoot region. The forefoot region, the heel region, and the midfoot region are also referred to as the forefoot portion, the heel portion, and the midfoot portion, respectively. The footwear according to the present disclosure may be athletic footwear, such as football, soccer, or cross-training shoes, or the footwear may be for other activities, such as but not limited to other athletic activities. Embodiments of the footwear generally include an upper, and a sole structure coupled to the upper.

More specifically, a sole structure for an article of footwear comprises a first plate and a second plate. The first plate overlies at least a portion of a forefoot region of the second plate. The first plate and the second plate are fixed to one another rearward of the forefoot region. The first plate is configured to slide longitudinally relative to the forefoot region of the second plate in a first portion of a flexion range during dorsiflexion of the sole structure, and to interfere with the second plate during a second portion of the flexion range that includes flex angles greater than in the first portion of the flexion range. The first portion of the flexion range includes flex angles of the sole structure less than a first predetermined flex angle. The second portion of the flexion range includes flex angles of the sole structure greater than or equal to the first predetermined flex angle. The sole structure has a change in bending stiffness at the first predetermined flex angle, thereby providing a nonlinear bending stiffness. Bending stiffness may also be referred to herein as bend stiffness. As used in this description and the accompanying claims, the phrase "bending stiffness" generally means a resistance to flexion of the sole structure exhibited by a material, structure, assembly of two or more components or a combination thereof, according to the disclosed embodiments and their equivalents. In a nonlimiting example, the first predetermined flex angle is an angle selected from the range of angles extending from 35 degrees to 65 degrees.

In an embodiment, a connector feature fixes the first plate to the second plate and prevents relative movement between the first plate and the second plate at the connector feature. The connector feature is disposed in a midfoot region or a heel region of the second plate. The connector feature includes a protrusion in one of the first plate and the second plate, and the protrusion extends into another one of the first plate and the second plate.

In an embodiment, a first one of the first plate and the second plate has an abutment spaced longitudinally apart from the connector feature. A second one of the first plate and the second plate has a confronting surface. The abutment and the confronting surface are spaced apart from one another by a gap when the sole structure is in an unflexed, relaxed state, and are in contact with one another during the second portion of the flexion range.

In an embodiment, the second one of the first plate and the second plate has a slot, and the confronting surface is a wall of the second one of the first plate and the second plate bounding the slot. The abutment extends into the slot. Dorsiflexion of the sole structure in the first portion of the flexion ranges changes a position of the abutment in the slot.

In an embodiment, the second plate has a foot-facing surface with a recess in the foot-facing surface. The first plate is disposed in the recess. The confronting surface is an anterior end of the first plate. The abutment is a wall of the second plate at an anterior end of the recess. The gap is in the recess between the anterior end of the first plate and the wall. The wall may be perpendicular to the foot-facing surface, but is not limited to such an orientation. Additionally, an upper surface of the first plate and the foot-facing surface of the second plate may be coplanar.

In an example embodiment, the second plate is an outsole. In another example embodiment, the sole structure includes an outsole and the second plate is between first plate and outsole. In an example embodiment, the first plate extends at least from the forefoot region of the second plate to a midfoot region of the second plate. In another example embodiment, the first plate extends at least from the forefoot region of the second plate to a heel region of the second plate.

In an embodiment, a sole structure for an article of footwear comprises a first plate and a second plate. The first plate overlies at least a portion of a forefoot region of the second plate. A connector feature connects the first plate to the second plate and prevents relative movement between the first plate and the second plate at the connector feature. A first one of the first plate and the second plate has an abutment spaced longitudinally apart from the connector feature. A second one of the first plate and the second plate has a confronting surface. The abutment and the confronting surface are spaced apart from one another by a gap when the sole structure is in an unflexed, relaxed state. Dorsiflexion of the sole structure causes longitudinal displacement of the first plate relative to the second plate at the gap until the first plate operatively engages with the second plate by the confronting surface contacting the abutment, such that the first plate flexes free of compressive loading by the second plate when a forefoot portion of the sole structure is dorsiflexed in a first portion of a flexion range, and is operatively engaged with and under compressive loading by the second plate when the forefoot portion of the sole structure is dorsiflexed in a second portion of the flexion range that includes flex angles greater than in the first portion of the flexion range. The first portion of the flexion range includes flex angles of the sole structure less than a first predetermined flex angle. The second portion of the flexion range includes flex angles of the sole structure greater than or equal to the first predetermined flex angle. The sole structure has a change in bending stiffness at the first predetermined flex angle.

In an embodiment, the connector feature is in a midfoot region or in a heel region of the second plate, the first plate has a slot in a forefoot region of the first plate, the second plate has an arm in the forefoot region of the second plate that extends into the slot, a position of the arm in the slot changes in the first portion of the flexion range, and the arm interferes with the second plate at the end of the slot in the second portion of the flexion range. In an embodiment, the second plate has a foot-facing surface with a recess in the foot-facing surface, the first plate is disposed in the recess, and an anterior end of the first plate contacts a wall of the second plate at an anterior end of the recess in the second portion of the flexion range.

The above features and advantages and other features and advantages of the present teachings are readily apparent from the following detailed description of the modes for carrying out the present teachings when taken in connection with the accompanying drawings.

"A," "an," "the," "at least one," and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

The terms "comprising," "including," and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

Those having ordinary skill in the art will recognize that terms such as "above," "below," "upward," "downward," "top," "bottom," etc., are used descriptively relative to the figures, and do not represent limitations on the scope of the invention, as defined by the claims.

Figure 2:
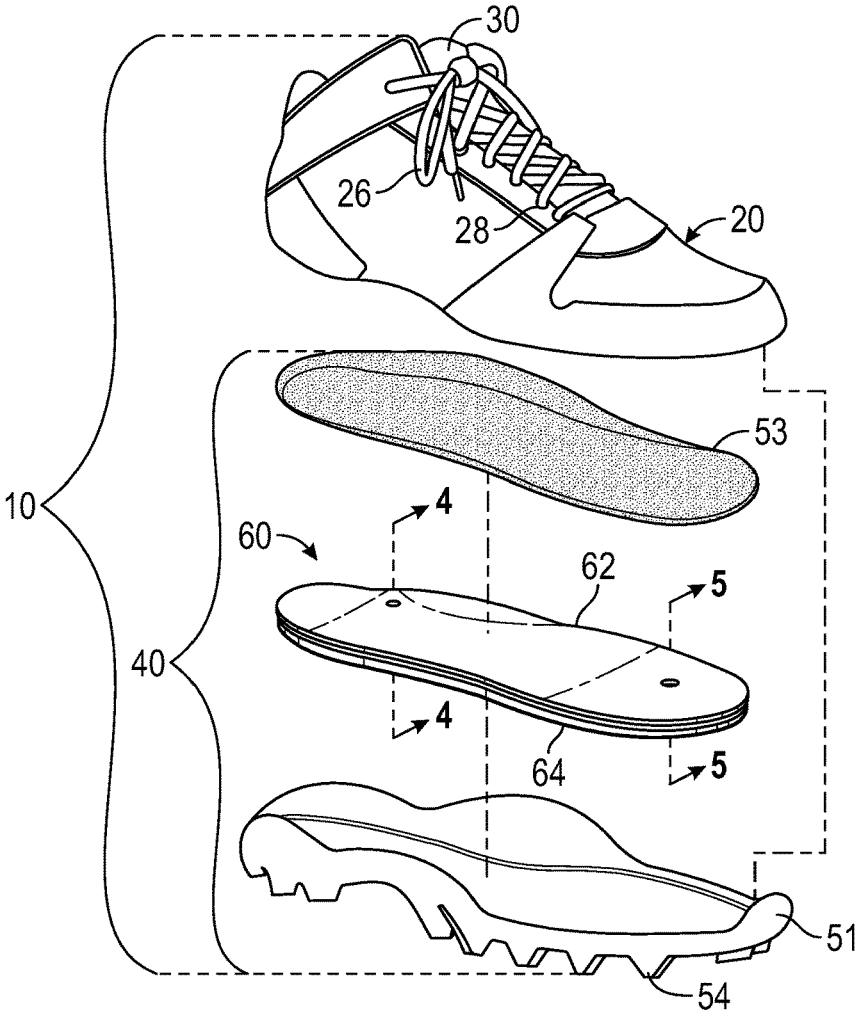
FIG. 2 is an exploded view of the footwear of FIG. 1.
Figure 3:
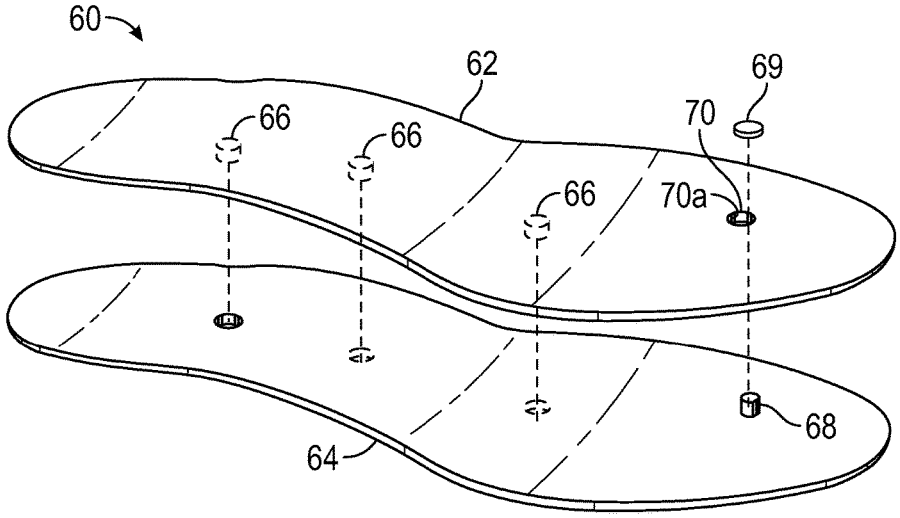
FIG. 3 is a lateral side perspective view of an exemplary embodiment of a stiffness enhancing assembly of the present disclosure.
Figure 4:
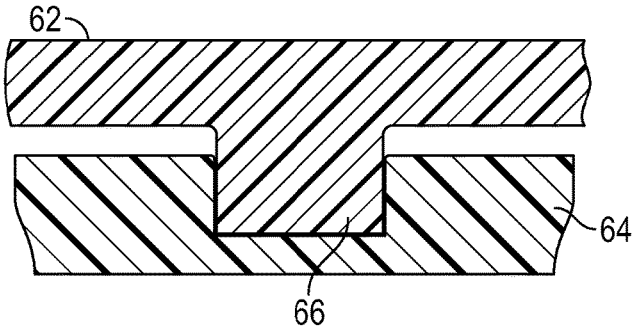
FIG. 4 is a fragmentary cross-sectional view of the stiffness enhancing assembly taken along line 4-4 of FIG. 2.

Referring to the drawings, wherein like reference numbers refer to like components throughout the views, an exemplary embodiment of an article of footwear 10 according to the present disclosure is shown in FIGS. 1 and 2. In this exemplary embodiment, the footwear 10 is a cleated shoe and includes an upper 20 and a supporting sole structure 40 (which may be referred to herein as either "sole structure", "sole assembly", or "sole") coupled to a lower area of the upper 20. The upper may be coupled with the sole structure using any of one or more conventional techniques, such that the sole structure supports a wearer's foot during use. For descriptive convenience, footwear 10 may be considered to be divided into the three general regions; the forefoot region 10A, the midfoot region 10B, and the heel region 10C. The forefoot region 10A generally includes portions of footwear 10 positionally corresponding with forward portions of a user's foot during use, including the toes and the joints connecting the metatarsal bones with the phalangeal bones (interchangeably referred to as the "metatarsal-phalangeal joint", the "metatarsal-phalangeal joints", "MPJ", or "MPJ" joints herein). The midfoot region 10B extends between the forefoot region 10A and the heel region 10C, and generally includes portions of footwear 10 positionally corresponding with middle portions of a user's foot during use, including the foot's arch area. The heel region 10C is disposed rearwardly from the midfoot region 10B, and generally includes portions of footwear 10 corresponding with rear portions of a user's foot, including the heel and calcaneus bone.

The term "longitudinal," as used herein, refers to a direction extending along a length of the sole structure, e.g., from a forefoot portion to a heel portion of the sole structure. The term "transverse," as used herein, refers to a direction extending along a width of the sole structure, e.g., from a lateral side to a medial side of the sole structure. The term "forward" is used to refer to the general direction from the heel portion toward the forefoot portion, and the term "rearward" is used to refer to the opposite direction, i.e., the direction from the forefoot portion toward the heel portion. The term "anterior" is used to refer to a front or forward component or portion of a component.

Footwear 10 also includes a lateral side 12 and a medial side 14, which correspond with opposite sides of the footwear 10 and extend through each of regions 10A-10C. The lateral side 12 corresponds with an outside area of the foot, that is, the portion of a foot that faces away from the other foot. The medial side 14 corresponds with an inside area of the foot, that is, the portion of a foot that faces toward the other foot. Regions 10A-10C and sides 12 and 14 are not intended to demarcate precise areas of the footwear 10, but rather are intended to represent general areas of the footwear 10 to aid in the following discussion. In addition to footwear 10, the regions 10A-10C and sides 12 and 14 may also be applied to portions of the footwear, including but not limited to the upper 20, the sole structure 40, and individual elements thereof.

The upper 20 can be configured in a similar manner, with regard to dimensions, shape, and materials, for example, as any conventional upper suitable to support, receive and retain a foot of a wearer; e.g., an athlete. The upper 20 forms a void (also referred to as a foot-receiving cavity) configured to accommodate insertion of a user's foot, and to effectively secure the foot within the footwear 10 relative to an upper surface of the sole, or to otherwise unite the foot and the footwear 10. In the embodiment shown, the upper 20 includes an opening that provides a foot with access to the void, so that the foot may be inserted into and withdrawn from the upper 20 through the opening. The upper 20 typically further includes one or more components suitable to further secure a user's foot proximate the sole structure, such as but not limited to a lace 26, a plurality of lace-receiving elements 28, and a tongue 30, as will be recognized by those skilled in the art.

The upper 20 can be formed of one or more layers, including for example one or more of a weather-resistant, a wear-resistant outer layer, a cushioning layer, and a lining layer. Although the above described configuration for the upper 20 provides an example of an upper that may be used in connection with embodiments of the sole structure 40 and stiffness enhancing assembly 60, a variety of other conventional or nonconventional configurations for the upper may also be utilized. Accordingly, the features of upper 20 may vary considerably. Further, a removable cushion member 53, shown in FIG. 2, may optionally be inserted into the upper 20 to provide additional wearer comfort, and in some embodiments, the cushion member 53 may comprise the insole. In other embodiments, an insole may be securely coupled to a portion of a foot-facing surface of the midsole.

The sole structure 40 of the footwear 10 extends between the foot and the ground to, for example, attenuate ground reaction forces to cushion the foot, provide traction, enhance stability, and influence the motions of the foot. When the sole structure 40 is coupled to the upper 20, the sole structure and upper can flex in cooperation with each other.

Referring to FIG. 2, the sole structure 40 may be a unitary structure with a single layer that includes a ground-contacting element of the footwear, or the sole structure 40 may include multiple layers. For example, a non-limiting exemplary multiple layer sole structure may include three layers, referred to as an insole, a midsole, and an outsole for descriptive convenience herein. The insole 53 may comprise a thin, comfort-enhancing member located adjacent to the foot. The midsole forms the middle layer of the sole structure between the insole and the outsole, and serves a variety of purposes that may include controlling foot motions and shielding the foot from excessive ground reaction forces. In one or more of the disclosed embodiments, the midsole comprises a stiffness enhancing assembly 60, as shown in FIG. 2. The outsole 51 comprises a ground-contacting element of the footwear, and is usually fashioned from a durable, wear resistant material. Examples of such materials can include, but are not limited to, nylon, thermoplastic polyurethane, carbon fiber, and others, as would be recognized by an ordinarily skilled artisan. Ground contacting elements of the outsole 51 may include texturing or other traction features or elements, such as cleats 54, configured to improve traction with one or more types of ground surfaces (e.g., natural grass, artificial turf, asphalt pavement, dirt, etc.). The outsole 51 may also be referred to as a plate. Although the exemplary embodiments herein describe and depict the stiffness enhancing assembly 60 and its stiffness enhancing features as a midsole, or a portion of a midsole, the embodiments include likewise configured stiffness enhancing assembly embodiments disposed either of an outsole or an insole, or as a portion of an outsole or of an insole. Likewise, the embodiments encompass embodiments wherein the stiffness enhancing assembly comprises a combination of an insole and a midsole, a combination of a midsole and an outsole, or as a combination of an insole, a midsole, and an outsole. When configured as an outsole or outsole portion, one or more embodiments of the stiffness enhancing assembly include one or more ground contacting elements disposed at, attached to, or projecting from its lower, ground-facing side. The stiffness enhancing assembly may be part of either of a midsole, or an insole, or an outsole of the sole structure, or can comprise a combination of any two or more of the midsole, the insole, and the outsole. Various ones of the plates 62, 64, 102, 106 described herein may be an insole plate, also referred to as an insole, an inner board plate, inner board, insole board, or lasting board. Still further, the plates could be a midsole plate or a unisole plate, or may be one of, or a unitary combination of any two or more of, an outsole, a midsole, and/or an insole (also referred to as an inner board plate). Optionally, an insole plate, or other layers may overlay the plates between the plates and the foot.

In the embodiment of FIGS. 3-10, the stiffness enhancing assembly 60 is at least partially secured to the outsole 51 and is positioned between the outsole 51 and the upper 20, or in the case where there is an insole and/or midsole between the outsole and the midsole or insole. The stiffness enhancing assembly 60 provides a nonlinear bending stiffness along the flexion range, such that the outsole 51 and unrestricted stiffness enhancing assembly 60 have a first bending stiffness within the first portion of the flexion range of the sole structure, and outsole 51 and restricted stiffness enhancing assembly 60 have a seconding bend stiffness within the second portion of the flexion range of the sole structure. The second bending stiffness is greater than the first bending stiffness. The second portion of the flexion range includes flex angles greater than flex angles in the first portion of the flexion range.

FIGS. 3-10 provide an exemplary embodiment of the stiffness enhancing assembly 60 according to the present disclosure. In this exemplary embodiment, the stiffness enhancing assembly 60 includes a pair of stiffness enhancing members 62 and 64 that include at least a forefoot region 10A and that, in some embodiments, can extend between the forefoot region 10A and the heel region 10C of the sole structure 40, or between the forefoot region 10A and the midfoot region 10B of the sole structure 40. In the embodiment shown in FIGS. 3-10, the stiffness enhancing members 62 and 64 are plates (alternatively referred to herein as "plate member" or "plate members"). A plate can be but is not necessarily flat and need not be a single component but instead can be multiple interconnected components. For example, a sole plate may be pre-formed with some amount of curvature and variations in thickness when molded or otherwise formed in order to provide a shaped footbed and/or increased thickness for reinforcement in desired areas. For example, the sole plate could have a curved or contoured geometry that may be similar to the lower contours of the foot 52, and may have curves and contours similar to those in the outsole 51. More specifically, the plate 62 is referred to as a first plate, a first plate member, or a first one of the plates, and the plate 64 is referred to as a second plate, a second plate member, or a second one of the plates. The plates 62 and 64 may be dimensioned similar to the outsole 51, or the plates 62 and 64 may be dimensioned as a scaled version of the outsole 51.

The plates 62 and 64 are at least partially secured to the outsole 51, or to one another, via a connection feature 66, for example, so that the plates 62 and 64 are positioned between the outsole 51 and upper 20 (or between outsole and midsole or insole as noted above) to prevent longitudinal movement of one plate relative to the other plate at the connection feature 66. The connection via connection feature 66 between the plates and/or between the plates and another portion of the sole structure, such as the outsole 51, can comprise any of a number of techniques or structures capable of securing the plates to each other, and/or securing the plates to each other and to the outsole 51, including for example, fasteners, adhesives, thermal bonding, and/or RF welds. In one embodiment, the plates 62 and 64 are secured together in the heel region 10C to prevent longitudinal movement of one plate (e.g., plate 62) relative to the other plate (e.g., plate 64) in the heel region. In another embodiment, the plates 62 and 64 can be secured together in the midfoot region 10B to prevent longitudinal movement of one plate (e.g., plate 62) relative to the other plate (e.g., plate 64) in the midfoot region. In another embodiment, the plates 62 and 64 can be secured together in the forefoot region 10A to prevent free-flow longitudinal movement of one plate (e.g., plate 62) relative to the other plate (e.g., plate 64) in the forefoot region. In the exemplary embodiment shown in FIG. 3, the stiffness enhancing members 62 and 64 are secured to the outsole 51, or to one another, via a connection feature 66 in the heel region 10C, the stiffness enhancing member 62 has a slot 70 in the forefoot region 10A, and the stiffness enhancing member 64 has an abutment, which is at least partially vertical in the embodiment shown, such as the arm 68 extending from the forefoot region 10A.

Figure 5:
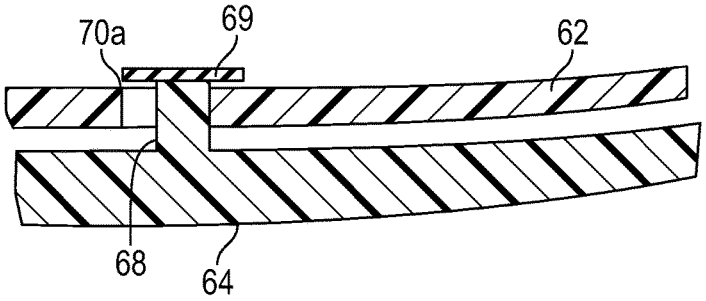
FIG. 5 is a fragmentary cross-sectional view of the stiffness enhancing assembly taken along line 5-5 of FIG. 2.
Figure 6:
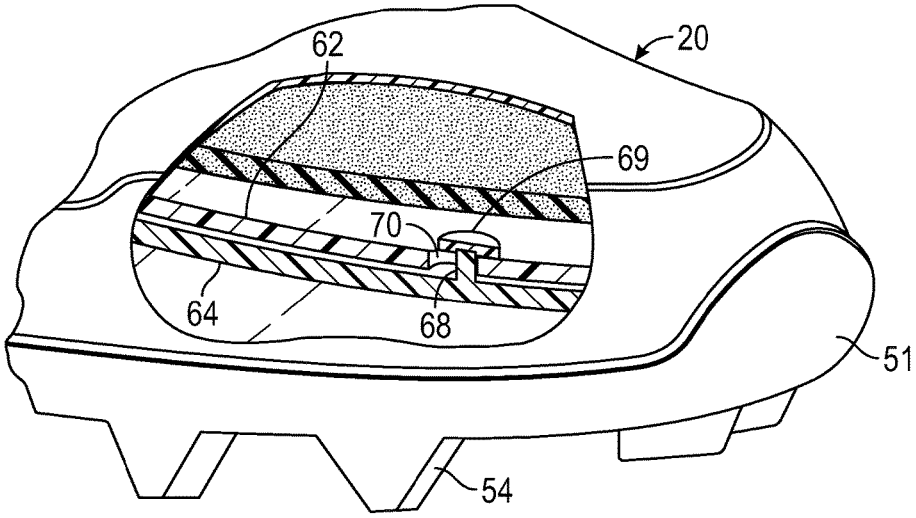
FIG. 6 is an enlarged fragmentary perspective view of a forefoot region of the footwear of FIG. 1.

The stiffness enhancing members 62 and 64 are positioned in a substantially parallel relationship to one another, with a ground-facing surface of stiffness enhancing member 62 confronting a foot-facing surface of stiffness enhancing member 64. Stated differently, the stiffness enhancing member 62 overlays the stiffness enhancing member 64. The arm 68 extending from one stiffness enhancing member (e.g., member 64) fits within the slot 70 in the other stiffness enhancing member (e.g., member 62), and optionally, a cap 69 maintains the arm 68 within the slot 70. The cap 69 may be any structure capable of maintaining the arm 68 within the slot 70 while allowing relative movement of the arm 68 within the slot 70. For example, the cap 69 may be a press fit or threaded member that is larger in size than the arm 68, a fastener, or a widening of the arm 68, as shown in FIG. 5.

The stiffness enhancing members, e.g., plates 62 and 64, can be fashioned from a durable, wear resistant material that is sufficiently rigid to provide the bending stiffness described herein during the flexion range of the sole structure 40. Examples, of such durable, wear resistant materials include nylon, thermoplastic polyurethane, carbon fiber, etc. The stiffness enhancing members can both be fashioned from the same durable, wear resistant material so that the stiffness properties of each stiffness enhancing member 62 and 64 is substantially the same. Alternatively, each of the stiffness enhancing members can be fashioned from a different durable, wear resistant material, to provide different stiffness properties. In either embodiment, the stiffness enhancing members 62, 64 together provide the nonlinear stiffness described herein. Either or both of the plates 62 and 64 may be entirely of a single, uniform material, or may each have different portions comprising different materials that may be, for example, co-injection molded or over-molded. For example, a first material of the forefoot region can be selected to achieve the desired bending stiffness in the forefoot region, while a second material of the midfoot region and the heel region can be a different material that has little effect on the bending stiffness of the forefoot region.

Figure 7:
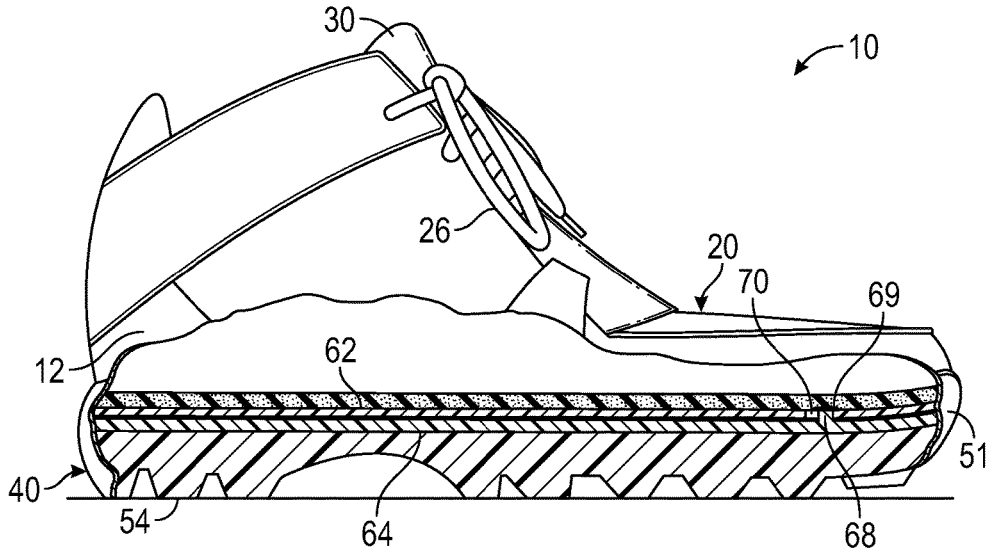
FIG. 7 is a lateral side elevation view of the footwear of FIG. 1, with the sole structure in an unflexed, relaxed position, including a partial sectional view of the stiffness enhancing assembly according to an exemplary embodiment.
Figure 7A:
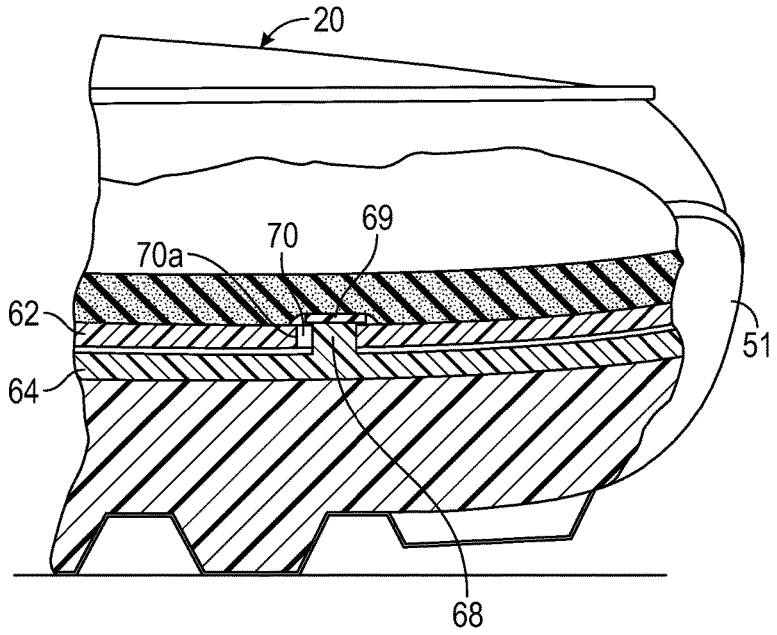
FIG. 7*a* is an enlarged fragmentary side elevation view of the forefoot region of the footwear of FIG. 7.
Figure 8A:
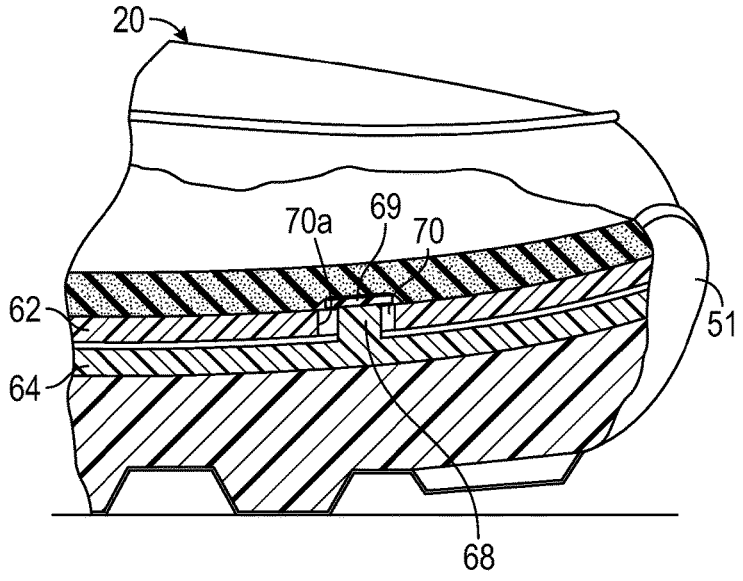
FIG. 8*a* is an enlarged fragmentary side elevation view of the forefoot region of the footwear of FIG. 8.

For the purpose of the present disclosure, the forefoot region of the outsole 51 and the stiffness enhancing assembly 60 are flexible, being capable of bending in dorsiflexion throughout a range of flex angles. This flexion range is conceptually divided into two portions, with a change in bending stiffness occurring at a predetermined flex angle at the start of the second predetermined flexion range. A first portion of the flexion range (also referred to as a first range of flexion) includes flex angles during dorsiflexion of the sole structure from zero (i.e., an unflexed, relaxed state of the sole structure 40 and stiffness enhancing assembly 60, as seen in FIG. 7 for example), to any flex angle less than the first predetermined flex angle (defined as angle A1 when the plate 62 operatively engages with the plate 64 (i.e., when the arm 68 engages wall 70*a* in slot 70), seen in FIGS. 10 and 10*a*. It is noted that when in the unflexed position, the forefoot region of the sole structure 40 including the stiffness enhancing assembly 60 may be generally flat as shown in FIG. 7, or alternatively, the forefoot region of the sole structure 40 including the stiffness enhancing assembly 60 may have a preformed curvature. A second portion of the flexion range (also referred to as a second range of flexion) includes flex angles of the sole structure 40 greater than or equal to the first predetermined flex angle A1, and begins as soon as the sole structure 40 is dorsiflexed to the first predetermined flex angle, and extends throughout greater flex angles with any further dorsiflexion of the sole structure 40 including the stiffness enhancing assembly 60 through progressively increasing angles of flexure greater than first predetermined flex angle A1. In the first portion of the flexion range, the arm 68 is within the slot 70 such as at the forward end of the slot 70 as shown in FIG. 7*a*. Progressive dorsiflexion causes the position or the arm 68 within the slot 70 to change, moving toward the wall 70*a*, as indicated in FIGS. 8*a*, 9*a*, and 10*a*, until the arm 68 contacts the wall 70*a* at the first predetermined flex angle A1. Therefore, as used within this description, first contact between the arm 68 and wall 70*a* in slot 70 conceptually demarcates the first predetermined flex angle.

The first predetermined flex angle A1 is defined as the angle formed at the intersection between a first axis generally extending along a longitudinal midline at a ground-facing surface of a posterior portion of the outsole 51 and a second axis generally extending along a longitudinal midline at the ground-facing surface of an anterior portion of the outsole 51. The intersection of the first and second axes will typically be approximately centered both longitudinally and transversely relative to the stiffness enhancing assembly and under the MPJ joints. The numerical value of the first predetermined flex angle A1 is dependent upon a number of factors, notably but non-exclusively, the dimension of the slot 70, and the particular structure of the stiffness enhancing assembly according to alternative embodiments, as will be discussed further below.

In one exemplary embodiment, the first predetermined flex angle A1 is in the range of between about 30 degrees and about 60 degrees, with a typical value of about 55 degrees. In another exemplary embodiment, the first predetermined flex angle A1 is in the range of between about 15 degrees and about 30 degrees, with a typical value of about 25 degrees. In another example, the first predetermined flex angle A1 is in the range of between about 20 degrees and about 40 degrees, with a typical value of about 30 degrees. In particular, the first predetermined flex angle can be any one of 35°, 36°, 37°, 38°, 39°, 40°, 41°, 42°, 43°, 44°, 45°, 46°, 47°, 48°, 49°, 50°, 51°, 52°, 53°, 54°, 55°, 56°, 57°, 58°, 59°, 60°, 61°, 62°, 63°, 64°, or 65°. Generally, the specific flex angle or range of angles at which a change in the rate of increase in bending stiffness occurs is dependent upon the specific activity for which the article of footwear is designed.

As an ordinarily skilled artisan will recognize in view of the present disclosure, the stiffness enhancing assembly 60 will bend in dorsiflexion in response to forces applied by corresponding bending of a user's foot at the MPJ during physical activity. Throughout the first portion of the flexion range FR1, the bending stiffness (defined as the change in moment as a function of the change in flex angle) will remain approximately the same as bending progresses through increasing angles of flexion. Because bending within the first portion of the flexion range FR1 is primarily governed by inherent material properties of the materials of the stiffness enhancing assembly 60, a graph of torque (or moment) on the stiffness enhancing assembly 60 versus angle of flexion (the slope of which is the bending stiffness) in the first portion of the flexion range FR1 will typically demonstrate a smoothly but relatively gradually inclining curve (referred to herein as a "linear" region with constant bending stiffness). At the boundary between the first and second portions of the range of flexion, however, structures of the stiffness enhancing assembly 60 engage, as described herein, such that additional material and mechanical properties exert a notable increase in resistance to further dorsiflexion. Therefore, a corresponding graph of torque versus angle of flexion (the slope of which is the bending stiffness) that also includes the second portion of the flexion range FR2 would show—beginning at an angle of flexion approximately corresponding to angle A1—a departure from the gradually and smoothly inclining curve characteristic of the first portion of the flexion range FR1. This departure is referred to herein as a "nonlinear" increase in bending stiffness, and would manifest as either or both of a stepwise increase in bending stiffness and/or a change in the rate of increase in the bending stiffness. The change in rate can be either abrupt, or it can manifest over a short range of increase in the bend angle (i.e., also referred to as the flex angle or angle of flexion) of the stiffness enhancing assembly 60. In either case, a mathematical function describing a bending stiffness in the second portion of the flexion range FR2 will differ from a mathematical function describing bending stiffness in the first portion of the flexion range.

Figure 8:
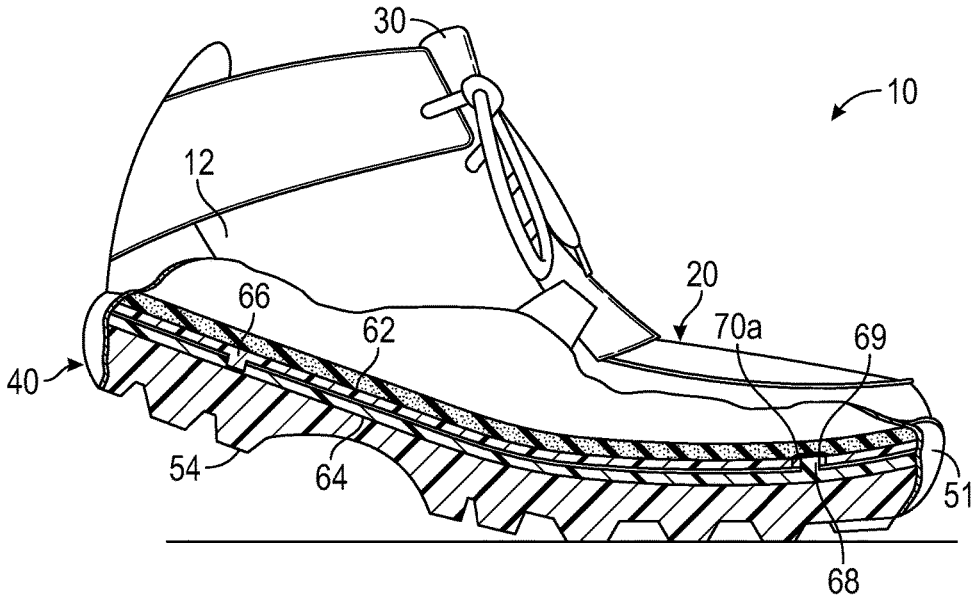
FIG. 8 is a lateral side elevation view of the footwear of FIG. 7 with the sole structure in a partially flexed condition.
Figure 9:
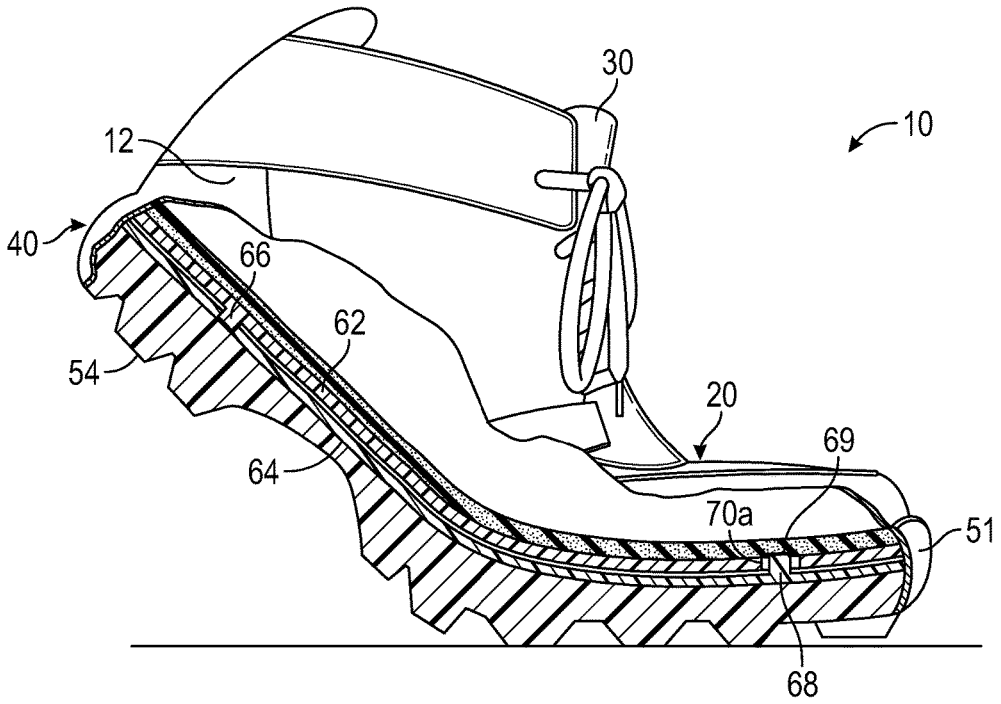
FIG. 9 is a lateral side elevation view of the footwear of FIG. 8 with the sole structure further flexed nearly to an end of a first portion of its flexion range.
Figure 9A:
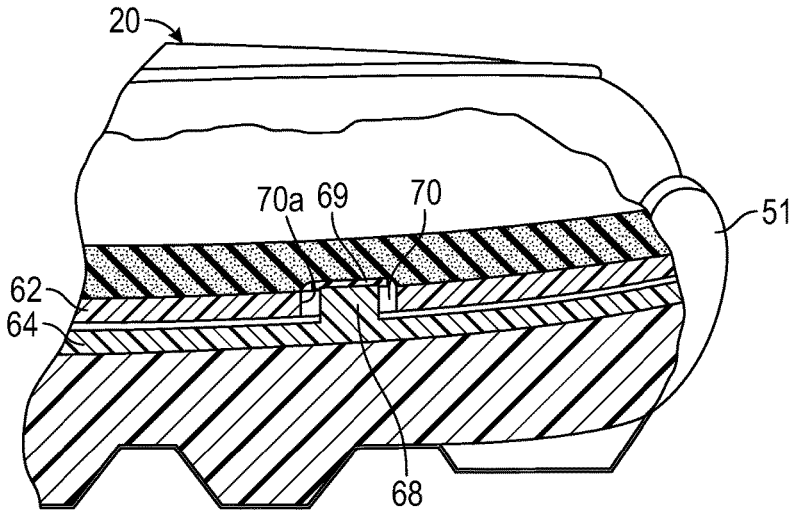
FIG. 9*a* is an enlarged fragmentary side elevation view of the forefoot region of the footwear of FIG. 9.
Figure 10:
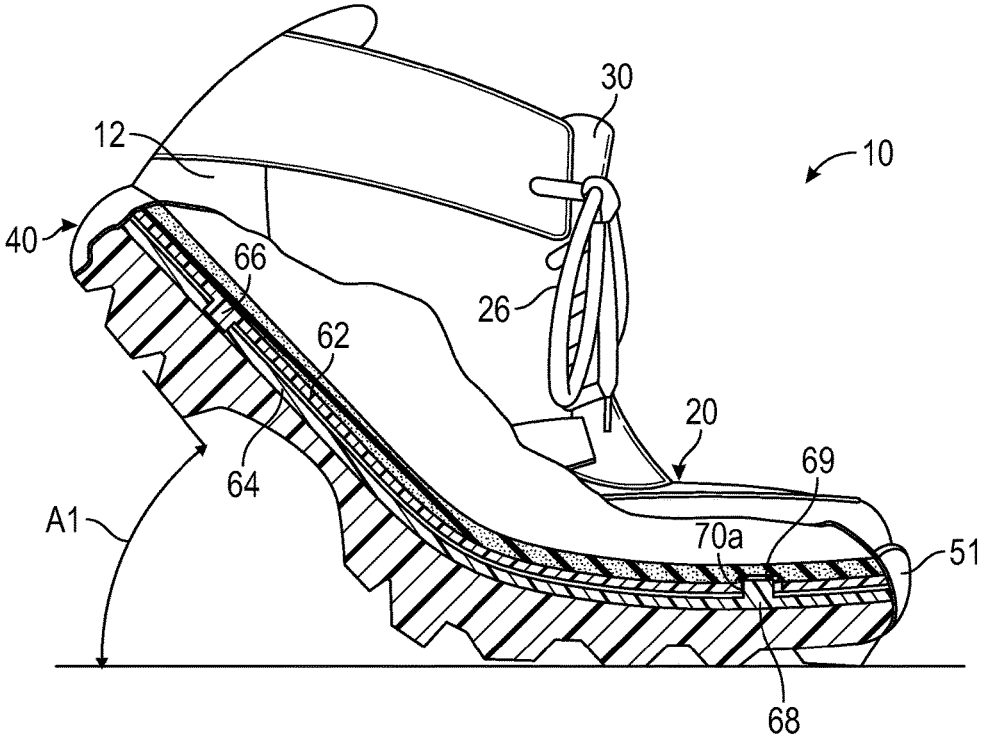
FIG. 10 is a lateral side elevation view of the footwear of FIG. 9 with the sole structure flexed to the end of the first portion of its flexion range.
Figure 10A:
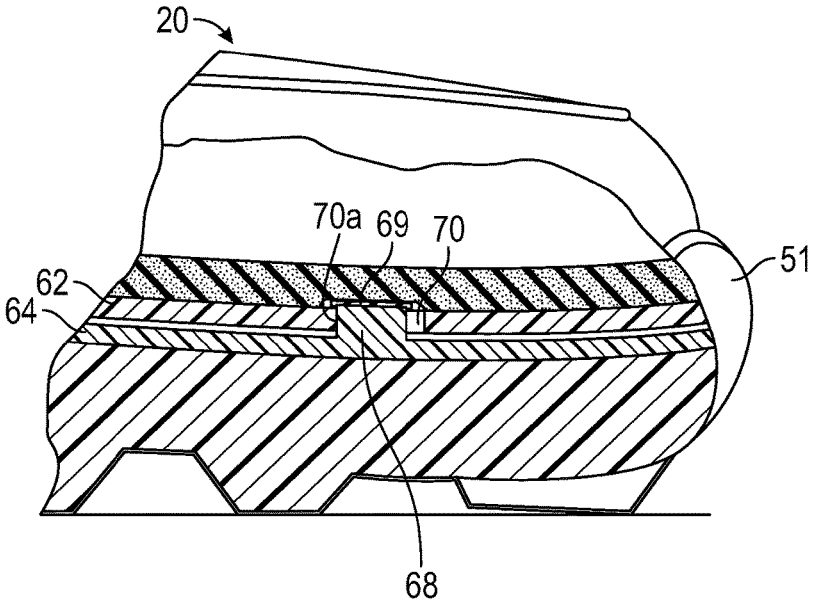
FIG. 10*a* is an enlarged fragmentary side elevation view of the forefoot region of the footwear of FIG. 10.
Figure 11:
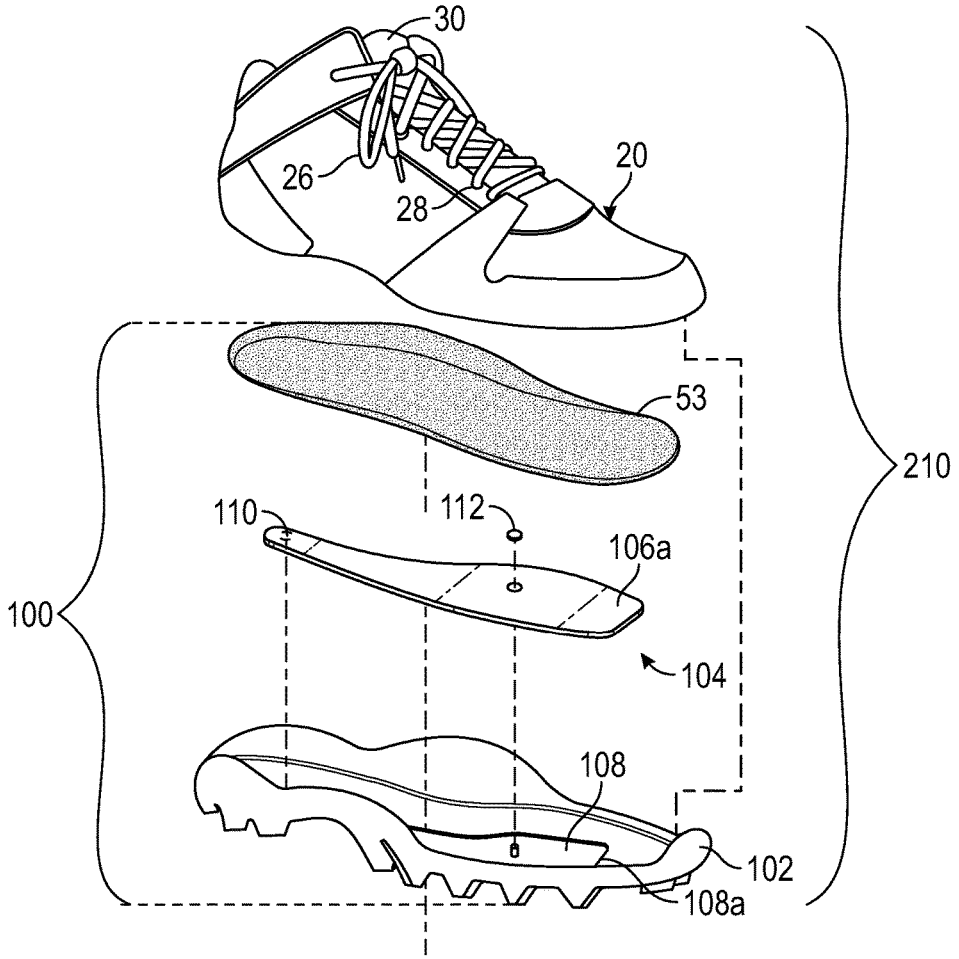
FIG. 11 is a lateral side exploded perspective view of an article of footwear according to another exemplary embodiment of the present disclosure.

In the configuration of FIGS. 3-10*a*, and starting from an unflexed, relaxed position, seen in FIGS. 7 and 7*a*, when the sole structure 40 is flexed within the first portion of its flexion range, stiffness enhancing member 62 slides relative to stiffness enhancing member 64 in the forefoot region. Correspondingly, the slot 70 in stiffness enhancing member 62 slides relative to arm 68 extending from stiffness enhancing member 64 (as seen in FIGS. 8, 8*a*, 9 and 9*a*), from an anterior position toward a posterior position within the slot, such that relative longitudinal movement of the stiffness enhancing members is unrestricted. In FIGS. 8 and 8*a*, the arm 68 is at roughly a midpoint within the slot 70. In FIGS. 9 and 9*a* the arm 68 is at the posterior end of the slot 70 such that the arm 68 is about to engage the wall 70*a* in slot 70. The point at which the arm 68 engages the wall 70*a* in slot 70, seen in FIGS. 10 and 10*a*, is the beginning of the second portion of the flexion range of the sole structure. Throughout the second portion of the flexion range of the sole structure, the outsole 51 and the stiffness enhancing members 62 and 64 restricted by the arm 68 engaging wall 70*a* in slot 70 collectively provide the second bending stiffness of the sole structure 40.

In another exemplary embodiment, the stiffness enhancing members 62 and 64 can be secured to the outsole 51 at a connection feature 66 in the forefoot region 10A at a point anterior to where the user's metatarsal-phalangeal joints would be supported on the sole structure. The stiffness enhancing member 62 has a slot 70 in the heel region 10C, that receives the arm 68 extending from the stiffness enhancing member 64 in the heel region 10C. In this exemplary embodiment, when the sole structure 40 is flexed within the first portion of its flexion range, the arm 68 extending from stiffness enhancing member 64 slides within slot 70 in stiffness enhancing member 62, such that the outsole 51 and unrestricted stiffness enhancing members collectively provide the first bending stiffness of the sole structure 40. When the sole structure 40 is further flexed to the end of the first portion of its flexion range, the arm 68 extending from stiffness enhancing member 64 engages a posterior wall of the slot 70 in stiffness enhancing member 62, restricting further relative motion of stiffness enhancing member 62 relative to stiffness enhancing member 64. Throughout the second portion of the flexion range of the sole structure, the outsole 51 and restricted stiffness enhancing members 62 and 64 collectively exert the second bend stiffness on the sole structure 40.

Throughout the first portion of the flexion range, the first bending stiffness is at least partially correlated with the individual stiffnesses of the outsole 51 and stiffness enhancing members 62 and 64, plus other factors such as friction between the stiffness enhancing members 62 and 64, etc. However, the arm 68 engages the wall of slot 70 and restricts further relative motion between the stiffness enhancing members 62 and 64. The stiffness enhancing member 62 is subjected to compressive forces of the stiffness enhancing member 64 acting on the stiffness enhancing member 62 between the fixed connection feature 66 and the arm 68, and the stiffness enhancing member is subjected to additional tensile forces. Accordingly, the second bend stiffness additionally comprises stiffness enhancing member's 62 resistance to compression, and stiffness enhancing member's 64 resistance to elongation. These additional factors notably increase the second bending stiffness relative to the first bending stiffness. As will be understood by those skilled in the art, during bending of the sole structure 40 as the foot is dorsiflexed, there is a neutral axis of the sole structure above which the sole structure is in compression, and below which the sole structure is in tension. The operative engagement of the plates 62, 64 (i.e., when the arm 68 contacts the wall of the plate 62 at the end of the slot 70) places additional tension on the sole structure 40 below the neutral axis, such as at a bottom surface of the plate 64, effectively shifting the neutral axis of the sole structure 40 upward (away from the bottom surface). The operative engagement of the plates 62, 64 places additional compressive forces on the sole structure above the neutral plane, and additional tensile forces below the neutral plane, nearer the ground-facing surface. In addition to the mechanical (e.g., tensile, compression, etc.) properties of the sole structure, structural factors that likewise affect changes in bending stiffness during dorsiflexion include but are not limited to the thicknesses, the longitudinal lengths, and the medial-lateral widths of different portions of the plates 62, 64.

As described herein, a transition from the first bend stiffness to the second bend stiffness demarcates a boundary between the first portion of the flexion range and the second portion of the flexion range. As the materials and structures of the embodiment proceed through a range of increasing flexion, they may tend to increasingly resist further flexion. Therefore, a person having an ordinary level of skill in the relevant art will recognize in view of this specification and accompanying claims, that a stiffness of the sole structure throughout the first flexion range may not remain constant. Nonetheless, such resistance will generally increase linearly or progressively. By contrast, the embodiments disclosed herein provide for a stepwise, nonlinear increase in resistance to flexion at the boundary between the first portion of the flexion range and the second portion of the flexion range.

An amount of separation between a posterior wall of slot 70 and a posterior surface of arm 68, while the sole structure is in a relaxed, unflexed condition, affects an amount of flexion that a sole structure will achieve throughout the first portion of the flexion range before transitioning to the second portion of the flexion range. Providing a small separation distance will result in a second bending stiffness occurring at a smaller flex angle (i.e., a smaller first predetermined flex angle A1), while providing a longer separation distance will result in a second bending stiffness occurring at a larger flex angle (i.e., a larger first predetermined flex angle A1). A person having an ordinary level of skill in the relevant art is enabled, in view of this specification and accompanying claims, to adjust such separation to achieve any of a wide range of relationships between a first portion of a flexion range and a second portion of a flexion.

While the above describes the slot in stiffness enhancing member 62 and the arm 68 extending from stiffness enhancing member 64, one skilled in the art would readily recognize that the slot may be positioned in the stiffness enhancing member 64, and the arm 68 may extend from the stiffness enhancing member 62. In either configuration, the arm 68 is configured to withstand forces (e.g., impact force, sheer force, etc.) applied when it engages the wall of the slot 70. For example, the arm 68 may be fashioned from the same durable, wear resistant material as the stiffness enhancing members, such as nylon or thermoplastic polyurethane, carbon fiber, etc. Alternatively, the arm 68 may be fashioned from a different durable, wear-resistant material, such as Polyoxymethylene, a solid metal, a rigid polymer, or another suitable material as would be recognized by an ordinarily skilled artisan in view of this disclosure.

FIGS. 11-16 show another exemplary embodiment of an article of footwear 210 with a sole structure according to the present disclosure. In this exemplary embodiment, the sole structure 100 includes an outsole 102 and a stiffness enhancing assembly 104, both of which may be referred to as plates or plate members. More specifically, the stiffness enhancing member 104 may be referred to as a first plate or a first plate member, and the outsole 102 may be referred to as a second plate or a second plate member. As described in more detail above, the sole structure 100 is similar to the sole structure 40, in that it may generally include multiple layers, i.e., an insole, a midsole, and an outsole. Generally, the insole is a thin, comfort-enhancing member located adjacent to the foot. The outsole forms the ground-contacting element of footwear and is usually fashioned from a durable, wear resistant material, such as nylon or thermoplastic polyurethane, carbon fiber, etc., and the midsole forms the middle layer of the sole structure and serves a variety of purposes.

The stiffness enhancing assembly 104 in this exemplary embodiment includes a stiffness enhancing member 106, generally configured as a flattened, elongate plate (also referred to herein as a "plate" or "plate member") disposed within a recess 108 in a foot-facing surface of the underlying portions of the sole structure, e.g., another plate such as the outsole 102. More specifically, the stiffness enhancing member 106 is referred to as a first plate, a first plate member, or a first one of the plates, and the outsole 102 is referred to as a second plate, a second plate member, or a second one of the plates. In an exemplary embodiment, an upper surface of the stiffness enhancing member 106 and an upper surface of the outsole 102 are approximately coplanar with each other, and collectively form a foot-facing surface of the sole structure. The stiffness enhancing member 106 and the recess 108 may extend from the forefoot 10A of the outsole 102 to the heel region 10C of the outsole, as shown in FIG.

12. In another embodiment, the stiffness enhancing member 106 and the recess 108 may extend from the forefoot 10A of the outsole 102 to the midfoot region 10B of the outsole 102 or, in another embodiment, only in the forefoot region 10A.

Figure 12:
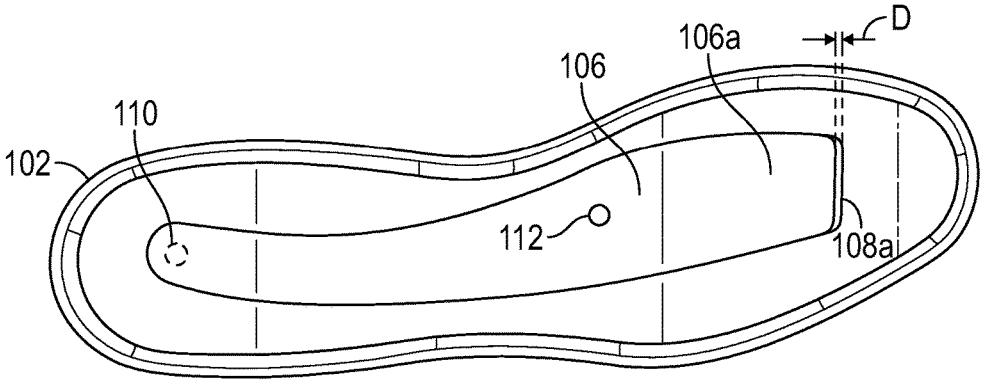
FIG. 12 is a plan view of a stiffness enhancing assembly of according to another exemplary embodiment of the present disclosure.

The stiffness enhancing member 106 overlays the outsole 102 and is secured to the outsole 102 at one or more connection features 110 and 112. Locating connection feature 112 more closely to an anterior portion 106*a* of the stiffness enhancing member 106 generally increases stiffness within at least the first portion of the flexion range, in contrast to when the connection feature 112 is located more distant from the anterior portion 106*a*, such as generally proximate a central portion 106*b* as shown in FIG. 12, and/or proximate a more posterior portion 106*c* as shown by connection feature 110, of the stiffness enhancing member 106, by constraining bending to a shorter portion of the stiffness enhancing member 106. As is evident in the figures, a slot in the stiffness enhancing member 106 allows the stiffness enhancing member 106 to slide relative to the outsole 102 at connection feature 112, but connection feature 110 fixes the stiffness enhancing member 106 to the outsole 102 to prevent relative movement.

As can be seen in FIG. 12, the recess 108 (labelled in FIG. A) is slightly larger than the stiffness enhancing member 106, so that the anterior portion 106*a* of the stiffness enhancing member 106 is spaced apart from an alternative vertical abutment, wall 108*a* in recess 108, by a distance "D" (or "gap"). The distance "D" is in the range of, for example, between about 1 millimeter and about 5 millimeters.

The stiffness enhancing member 106 can be fashioned from a durable, wear resistant material that is sufficiently rigid such that the sole structure provides a suitable bending stiffness during the flexion range of the sole structure, as described herein. Examples, of such durable, wear resistant materials include nylon, thermoplastic polyurethane, carbon fiber, etc. The stiffness enhancing member 106 can be fashioned from the same durable, wear resistant material as either the outsole 102, or the a midsole when the stiffness enhancing member is disposed within a recess in a midsole, etc., so that the stiffness of the outsole (or of the midsole) and the stiffness enhancing member 106 is substantially the same. Alternatively, the stiffness enhancing member can be fashioned from a different durable, wear resistant material than the outsole 102, to provide a different level of stiffness than either of the outsole or the midsole.

In this exemplary embodiment, the sole structure 100 provides a nonlinear stiffness such that the outsole 102 and the unrestricted stiffness enhancing member 106 collectively provide the first bending stiffness within the first portion of its flexion range. When the sole structure 100 is further flexed to the end of the first portion of its flexion range, the outsole 102 and the restricted stiffness enhancing member 106 collectively provide the second bend stiffness within the second portion of the flexion range of the sole structure. The second bending stiffness is preferably greater than the first bend stiffness.

Figure 13:
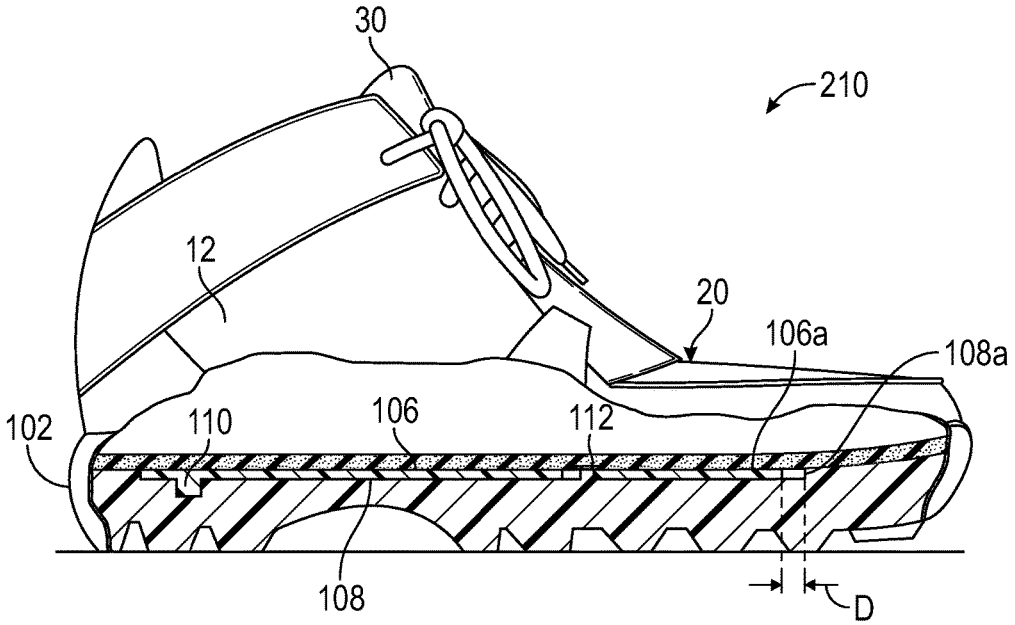
FIG. 13 is a lateral side elevation view of the footwear of FIG. 11 with the sole structure in an unflexed, relaxed position, including a partial sectional view of the stiffness enhancing assembly according to another exemplary embodiment.
Figure 13A:
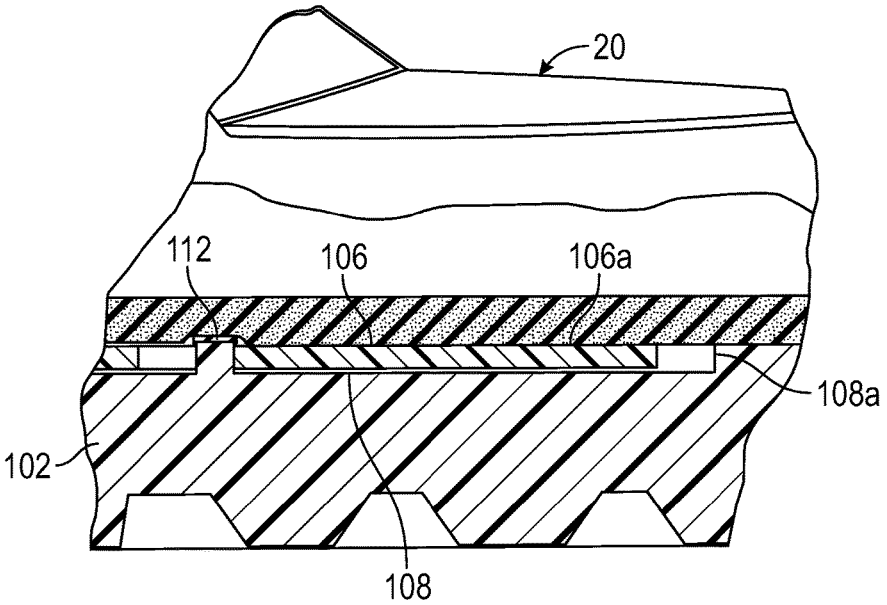
FIG. 13*a* is an enlarged fragmentary side elevation view of the forefoot region of the footwear of FIG. 13.
Figure 14:
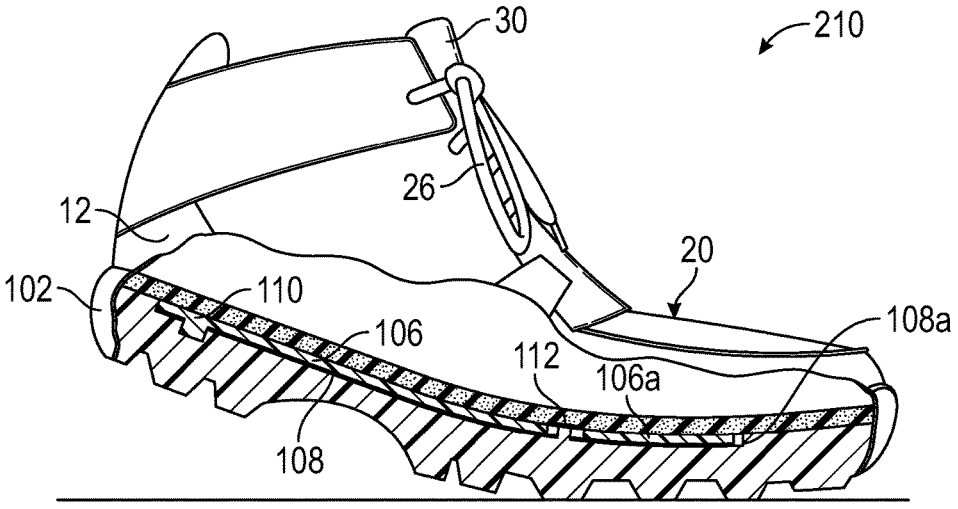
FIG. 14 is a lateral side elevation view of the footwear of FIG. 13 with the sole structure in a partially flexed condition.
Figure 14A:
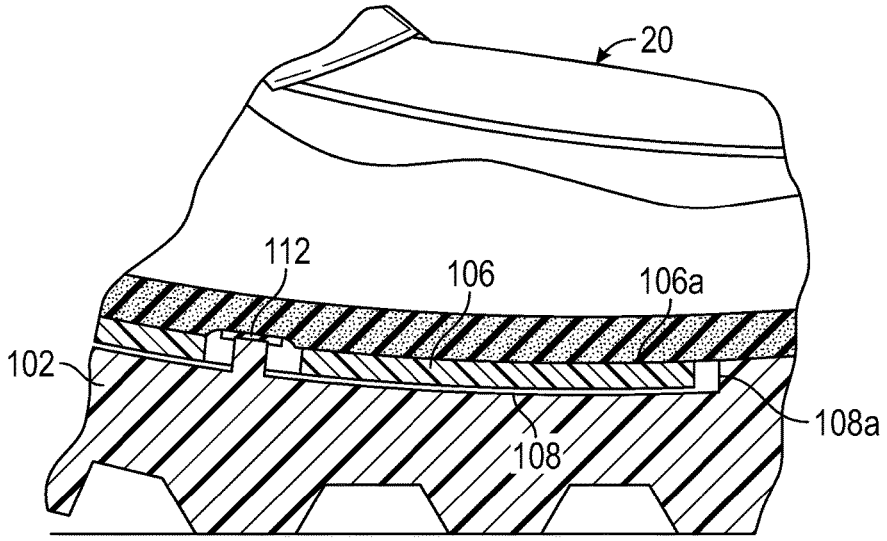
FIG. 14*a* is an enlarged fragmentary side elevation view of the forefoot region of the footwear of FIG. 14.
Figure 15:
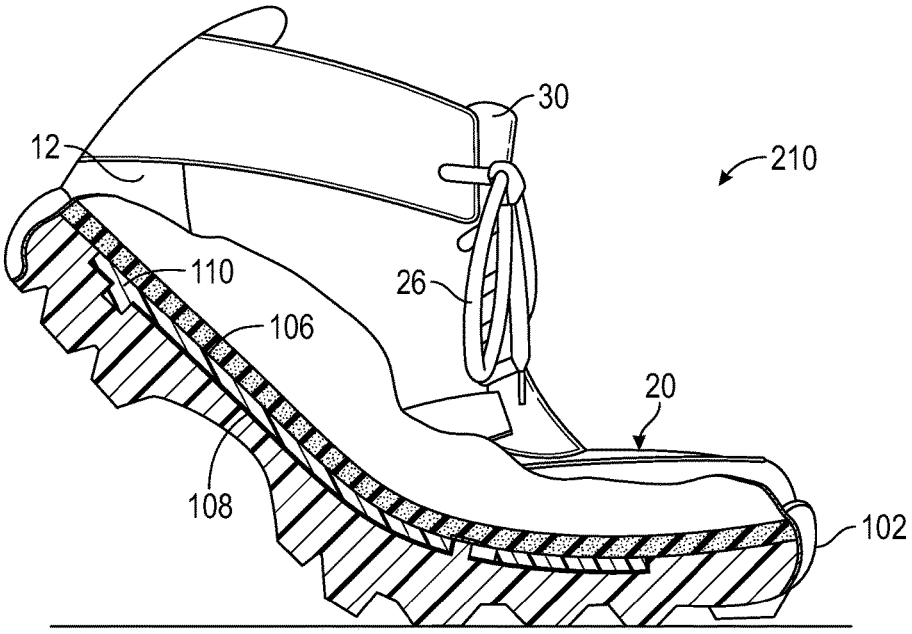
FIG. 15 is a lateral side elevation view of the footwear of FIG. 14 with the sole structure further flexed nearly to an end of a first portion of its flexion range.
Figure 15A:
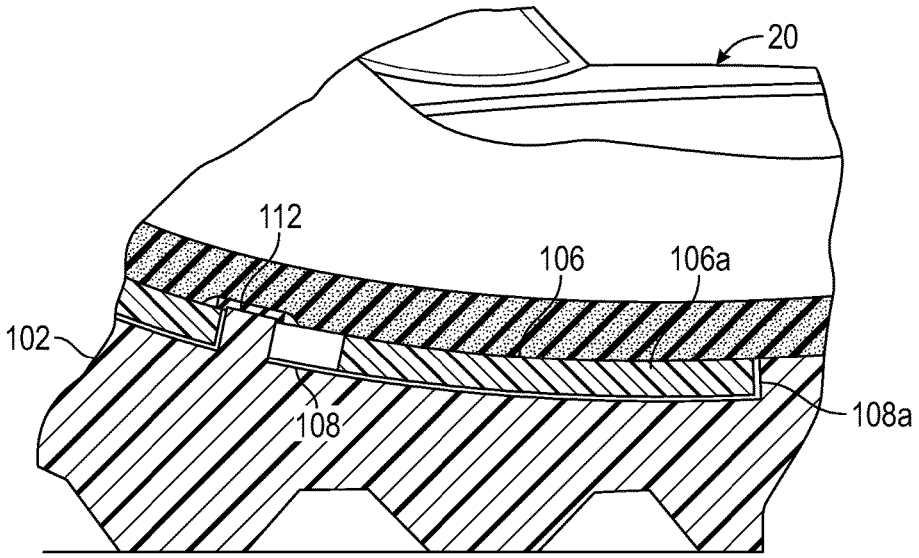
FIG. 15*a* is an enlarged fragmentary side elevation view of the forefoot region of the footwear of FIG. 15.
Figure 16:
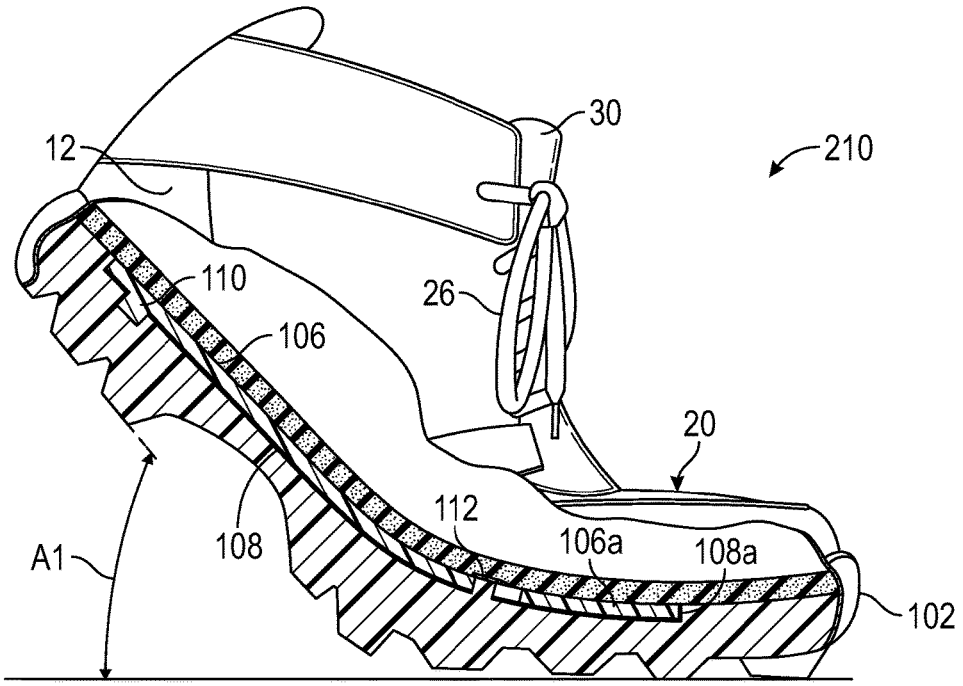
FIG. 16 is a lateral side elevation view of the footwear of FIG. 15 with the sole structure flexed to a first predetermined flex angle.
Figure 16A:
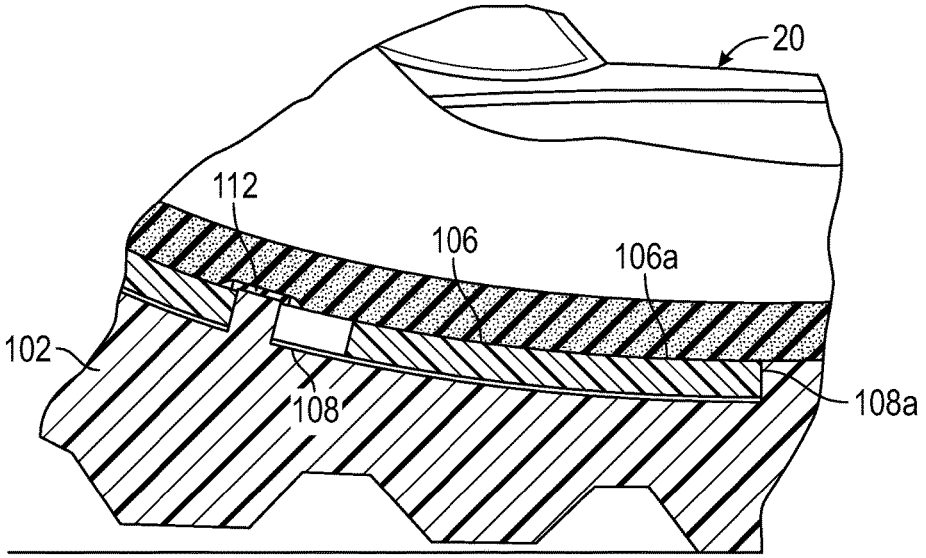
FIG. 16*a* is an enlarged fragmentary side elevation view of the forefoot region of the footwear of FIG. 16.

More specifically, in the exemplary embodiment of FIGS. 11-16, the stiffness enhancing member 106 is a plate positioned within the recess 108 in the outsole 102. In an unflexed, relaxed state, shown in FIGS. 13 and 13*a*, there is a space "D" between the anterior portion 106*a* of the stiffness enhancing member 106 and the anterior wall 108*a* of recess 108. During the first portion of the flexion range of the sole structure 100 (seen in FIGS. 14, 14*a*, 15 and 15*a*), the anterior portion 106*a* of the stiffness enhancing member 106 slides relative to the outsole 102 within the recess 108 in the outsole, along a longitudinal axis of the footwear, such that the unrestricted stiffness enhancing member 106 and the outsole collectively provide the first bending stiffness of the sole structure 100. In FIGS. 14 and 14*a*, the anterior portion 106*a* of the stiffness enhancing member 106 is at roughly a midpoint of the space "D", and in FIGS. 15 and 15*a* the anterior portion of the stiffness enhancing member 106 is at the anterior end of the recess 108 such that the anterior portion of the stiffness enhancing member 106 is about to engage the anterior wall 108*a* in recess 108. The flex angle at which the anterior portion of the stiffness enhancing member 106 engages the anterior wall 108*a* in recess 108 is seen in FIGS. 16 and 16*a*, and is the beginning of the second portion of the flexion range of the sole structure. When the sole structure 100 is flexed into the second portion of its flexion range (seen in FIG. 16), the anterior end of the stiffness enhancing member 106 remains engaged with the anterior wall 108*a* of the recess 108, restricting further relative motion of the stiffness enhancing member 106 relative to the sole structure 100, including for example, outsole 102. Throughout the second portion of the flexion range of the sole structure, the outsole 102 provides a compressive force on stiffness enhancing member 106, and the stiffness enhancing member 106, restricted by the anterior portion 106*a* of the stiffness enhancing member 106 engaging the anterior wall 108*a* in recess 108, collectively provide the second bending stiffness of the sole structure 100.

It will be understood that various modifications can be made to the embodiments of the present disclosure without departing from the spirit and scope thereof. Therefore, the above description should not be construed as limiting the disclosure, but merely as embodiments thereof. Those skilled in the art will envision other modifications within the scope and spirit of the invention as defined by the claims appended hereto. For example, the configurations of the stiffness enhancing assemblies and members contemplated by the present disclosure that may be configured as various different structures without departing from the scope of the present disclosure. Further, the types of materials used to provide the enhanced stiffness may include those described herein and others that provide the described stiffness enhancing function without departing from the scope of the present disclosure. While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative only and not as limiting.

What is claimed is:

1. A sole structure for an article of footwear comprising:

a first plate and a second plate;

a connector feature fixing the first plate to the second plate and preventing relative movement between the first plate and the second plate at the connector feature; wherein:

the first plate overlies at least a portion of a forefoot region of the second plate;

the first plate and the second plate are fixed to one another rearward of the forefoot region at the connector feature;

the connector feature is disposed in a midfoot region or a heel region of the second plate;

wherein a first one of the first plate and the second plate has an abutment spaced longitudinally apart from the connector feature;

a second one of the first plate and the second plate has a confronting surface;

the abutment and the confronting surface are spaced apart from one another by a gap when the sole structure is in an unflexed, relaxed state; and the confronting surface contacts the abutment when the first plate slides longitudinally relative to the forefoot region of the second plate during dorsiflexion of the sole structure.

2. The sole structure of claim 1, wherein:

the sole structure has a change in bending stiffness when the confronting surface contacts the abutment.

3. The sole structure of claim 2, wherein the confronting surface contacts the abutment when the sole structure is dorsiflexed at an angle selected from the range of angles extending from 35 degrees to 65 degrees.

4. The sole structure of claim 1, wherein the connector feature includes a protrusion in one of the first plate and the second plate, and the protrusion extends into another one of the first plate and the second plate.

5. The sole structure of claim 1, wherein:

the second one of the first plate and the second plate has a slot;

the confronting surface is a wall of the first second one of the first plate and the second plate bounding the slot; and the abutment extends into the slot.

6. The sole structure of claim 5, wherein dorsiflexion of the sole structure moves the abutment in the slot toward the confronting surface.

7. The sole structure of claim 1, wherein:

the second plate has a foot-facing surface with a recess in the foot-facing surface; and the first plate is disposed in the recess.

8. The sole structure of claim 7, wherein:

the confronting surface is an anterior end of the first plate;

the abutment is a wall of the second plate at an anterior end of the recess; and the gap is in the recess between the anterior end of the first plate and the wall.

9. The sole structure of claim 8, wherein the wall is perpendicular to the foot-facing surface.

10. The sole structure of claim 7, wherein an upper surface of the first plate and the foot-facing surface of the second plate are coplanar.

11. The sole structure of claim 7, wherein the second plate is an outsole.

12. The sole structure of claim 1, further comprising an outsole, and wherein the second plate is between first plate and outsole.

13. The sole structure of claim 1, wherein the first plate extends at least from the forefoot region of the second plate to a midfoot region of the second plate.

14. The sole structure of claim 1, wherein the first plate extends at least from the forefoot region of the second plate to a heel region of the second plate.

15. A sole structure for an article of footwear comprising:

a first plate and a second plate; wherein the first plate overlies at least a portion of a forefoot region of the second plate;

a connector feature connecting the first plate to the second plate and preventing relative movement between the first plate and the second plate at the connector feature;

wherein:

a first one of the first plate and the second plate have an abutment spaced longitudinally apart from the connector feature;

a second one of the first plate and the second plate has a confronting surface;

the abutment and the confronting surface are spaced apart from one another by a gap when the sole structure is in an unflexed, relaxed state; and dorsiflexion of the sole structure causes longitudinal displacement of the first plate relative to the second plate at the gap until the first plate operatively engages with the second plate by the confronting surface contacting the abutment, such that the first plate flexes free of compressive loading by the second plate when a forefoot portion of the sole structure is dorsiflexed in a first portion of a flexion range, and is operatively engaged with and under compressive loading by the second plate when the forefoot portion of the sole structure is dorsiflexed in a second portion of the flexion range that includes flex angles greater than in the first portion of the flexion range.

16. The sole structure of claim 15, wherein:

the first portion of the flexion range includes flex angles of the sole structure less than a first predetermined flex angle;

the second portion of the flexion range includes flex angles of the sole structure greater than or equal to the first predetermined flex angle; and the sole structure has a change in bending stiffness when the confronting surface contacts the abutment at the first predetermined flex angle.

17. The sole structure of claim 15, wherein:

the connector feature is in a midfoot region or in a heel region of the second plate;

the first plate has a slot in a forefoot region of the first plate;

the second plate has an arm in the forefoot region of the second plate that extends into the slot;

a position of the arm in the slot changes in the first portion of the flexion range; and the arm interferes with the second plate at the end of the slot in the second portion of the flexion range.

18. The sole structure of claim 15, wherein:

the second plate has a foot-facing surface with a recess in the foot-facing surface;

the first plate is disposed in the recess;

an anterior end of the first plate contacts a wall of the second plate at an anterior end of the recess in the second portion of the flexion range.

* * * * *